US009223268B2

(12) United States Patent
Yamaguchi et al.

(10) Patent No.: US 9,223,268 B2
(45) Date of Patent: Dec. 29, 2015

(54) FIXING DEVICE, BELT DEVICE, AND IMAGE FORMING APPARATUS

(71) Applicants: Yoshiki Yamaguchi, Kanagawa (JP); Kazuhito Kishi, Kanagawa (JP); Masahiro Samei, Osaka (JP); Ippei Fujimoto, Kanagawa (JP); Misaki Shimizu, Tokyo (JP); Yukiko Nakajima, Kanagawa (JP); Keisuke Kawabata, Kanagawa (JP); Yasunori Ishigaya, Kanagawa (JP); Haruyuki Honda, Kanagawa (JP)

(72) Inventors: Yoshiki Yamaguchi, Kanagawa (JP); Kazuhito Kishi, Kanagawa (JP); Masahiro Samei, Osaka (JP); Ippei Fujimoto, Kanagawa (JP); Misaki Shimizu, Tokyo (JP); Yukiko Nakajima, Kanagawa (JP); Keisuke Kawabata, Kanagawa (JP); Yasunori Ishigaya, Kanagawa (JP); Haruyuki Honda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/470,203

(22) Filed: Aug. 27, 2014

(65) Prior Publication Data

US 2015/0071688 A1 Mar. 12, 2015

(30) Foreign Application Priority Data

Sep. 6, 2013 (JP) ..... 2013-184893

(51) Int. Cl.
*G03G 15/20* (2006.01)

(52) U.S. Cl.
CPC .... *G03G 15/2053* (2013.01); *G03G 2215/2025* (2013.01)

(58) Field of Classification Search
CPC ..... G03G 15/2053; G03G 2215/2025
See application file for complete search history.

(56) References Cited

U.S. PATENT DOCUMENTS

| | | | | | |
|---|---|---|---|---|---|
| 4,429,985 | A * | 2/1984 | Yokota | 399/165 |
| 5,017,969 | A * | 5/1991 | Mitomi et al. | 399/299 |
| 5,119,143 | A * | 6/1992 | Shimura | 399/329 |
| 5,148,226 | A * | 9/1992 | Setoriyama et al. | 399/329 |
| 5,196,895 | A * | 3/1993 | Setoriyama et al. | 399/328 |
| 5,266,134 | A * | 11/1993 | Shimura | 156/84 |
| 6,014,539 | A * | 1/2000 | Sano et al. | 399/329 |
| 6,101,362 | A * | 8/2000 | Shimura et al. | 399/329 |
| 6,192,210 | B1 * | 2/2001 | Munenori et al. | 399/165 |
| 2010/0189477 | A1 * | 7/2010 | Yamada | 399/329 |
| 2011/0064493 | A1 | 3/2011 | Muramatsu et al. | |

(Continued)

FOREIGN PATENT DOCUMENTS

| | | |
|---|---|---|
| JP | 3-025477 | 2/1991 |
| JP | 6-095540 | 4/1994 |

(Continued)

OTHER PUBLICATIONS

Machine translation of JP 07089629 A.*

*Primary Examiner* — David Bolduc
(74) *Attorney, Agent, or Firm* — Oblon, McClelland, Maier & Neustadt, L.L.P.

(57) ABSTRACT

A fixing device includes a first support and a second support to rotatably support a fixing rotator at a first lateral end and a second lateral end of the fixing rotator in an axial direction thereof. A first stopper is mounted on the first support. A second stopper is mounted on the second support. A first skew restraint projects from an outer circumferential surface of the fixing rotator radially at the first lateral end of the fixing rotator in the axial direction thereof. A second skew restraint projects from the outer circumferential surface of the fixing rotator radially at the second lateral end of the fixing rotator in the axial direction thereof. The second skew restraint comes into contact with the second stopper as the fixing rotator moves in the axial direction thereof toward the first support.

20 Claims, 8 Drawing Sheets

(56) References Cited

U.S. PATENT DOCUMENTS

| | | | | |
|---|---|---|---|---|
| 2011/0182634 | A1 | 7/2011 | Ishigaya et al. | |
| 2011/0206402 | A1* | 8/2011 | Yamashina | 399/69 |
| 2011/0229200 | A1 | 9/2011 | Yamaguchi et al. | |
| 2012/0148303 | A1 | 6/2012 | Yamaguchi et al. | |
| 2012/0155935 | A1 | 6/2012 | Yoshikawa et al. | |
| 2013/0045032 | A1 | 2/2013 | Shimokawa et al. | |
| 2013/0126314 | A1* | 5/2013 | Mizoguchi et al. | 198/837 |
| 2013/0209124 | A1 | 8/2013 | Saito et al. | |
| 2014/0010578 | A1 | 1/2014 | Ishigaya et al. | |

FOREIGN PATENT DOCUMENTS

| | | | | | |
|---|---|---|---|---|---|
| JP | 6-345292 | | | 12/1994 | |
| JP | 07089629 | A | * | 4/1995 | B65H 5/02 |
| JP | 2001-343860 | | | 12/2001 | |
| JP | 2003-057895 | | | 2/2003 | |
| JP | 2005-181946 | | | 7/2005 | |
| JP | 2010185941 | A | * | 8/2010 | |
| JP | 2010189109 | A | * | 9/2010 | |
| JP | 2011039242 | A | * | 2/2011 | |
| JP | 2012-141328 | | | 7/2012 | |
| JP | 2012-230284 | | | 11/2012 | |

* cited by examiner

FIXING DEVICE, BELT DEVICE, AND IMAGE FORMING APPARATUS

CROSS-REFERENCE TO RELATED APPLICATION

This patent application is based on and claims priority pursuant to 35 U.S.C. §119 to Japanese Patent Application No. 2013-184893, filed on Sep. 6, 2013, in the Japanese Patent Office, the entire disclosure of which is hereby incorporated by reference herein.

BACKGROUND

1. Technical Field

Exemplary aspects of the present invention relate to a fixing device, a belt device, and an image forming apparatus, and more particularly, to a fixing device for fixing an image on a recording medium, a belt device incorporated in the fixing device, and an image forming apparatus incorporating the fixing device.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing sleeve, a fixing belt, and a fixing film, heated by a heater and a pressure rotator, such as a pressure roller and a pressure belt, pressed against the fixing rotator to form a fixing nip therebetween. As a recording medium bearing a toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and a pressure rotator pressed against the fixing rotator to form a fixing nip therebetween through which a recording medium bearing a toner image is conveyed. A first support rotatably supports the fixing rotator at a first lateral end of the fixing rotator in an axial direction thereof. A second support rotatably supports the fixing rotator at a second lateral end of the fixing rotator in the axial direction thereof. A first stopper is mounted on the first support. A second stopper is mounted on the second support. A first skew restraint projects from an outer circumferential surface of the fixing rotator radially at the first lateral end of the fixing rotator in the axial direction thereof. A second skew restraint projects from the outer circumferential surface of the fixing rotator radially at the second lateral end of the fixing rotator in the axial direction thereof. The second skew restraint comes into contact with the second stopper as the fixing rotator moves in the axial direction thereof toward the first support.

This specification further describes an improved belt device. In one exemplary embodiment, the belt device includes an endless belt rotatable in a predetermined direction of rotation. A first support rotatably supports the endless belt at a first lateral end of the endless belt in an axial direction thereof. A second support rotatably supports the endless belt at a second lateral end of the endless belt in the axial direction thereof. A first stopper is mounted on the first support. A second stopper is mounted on the second support. A first skew restraint projects from an outer circumferential surface of the endless belt radially at the first lateral end of the endless belt in the axial direction thereof. A second skew restraint projects from the outer circumferential surface of the endless belt radially at the second lateral end of the endless belt in the axial direction thereof. The second skew restraint comes into contact with the second stopper as the endless belt moves in the axial direction thereof toward the first support.

This specification further describes an improved image forming apparatus. In one exemplary embodiment, the image forming apparatus includes an image forming device to form a toner image and a fixing device, disposed downstream from the image forming device in a recording medium conveyance direction, to fix the toner image on a recording medium. The fixing device includes a fixing rotator rotatable in a predetermined direction of rotation and a pressure rotator pressed against the fixing rotator to form a fixing nip therebetween through which the recording medium bearing the toner image is conveyed. A first support rotatably supports the fixing rotator at a first lateral end of the fixing rotator in an axial direction thereof. A second support rotatably supports the fixing rotator at a second lateral end of the fixing rotator in the axial direction thereof. A first stopper is mounted on the first support. A second stopper is mounted on the second support. A first skew restraint projects from an outer circumferential surface of the fixing rotator radially at the first lateral end of the fixing rotator in the axial direction thereof. A second skew restraint projects from the outer circumferential surface of the fixing rotator radially at the second lateral end of the fixing rotator in the axial direction thereof. The second skew restraint comes into contact with the second stopper as the fixing rotator moves in the axial direction thereof toward the first support.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
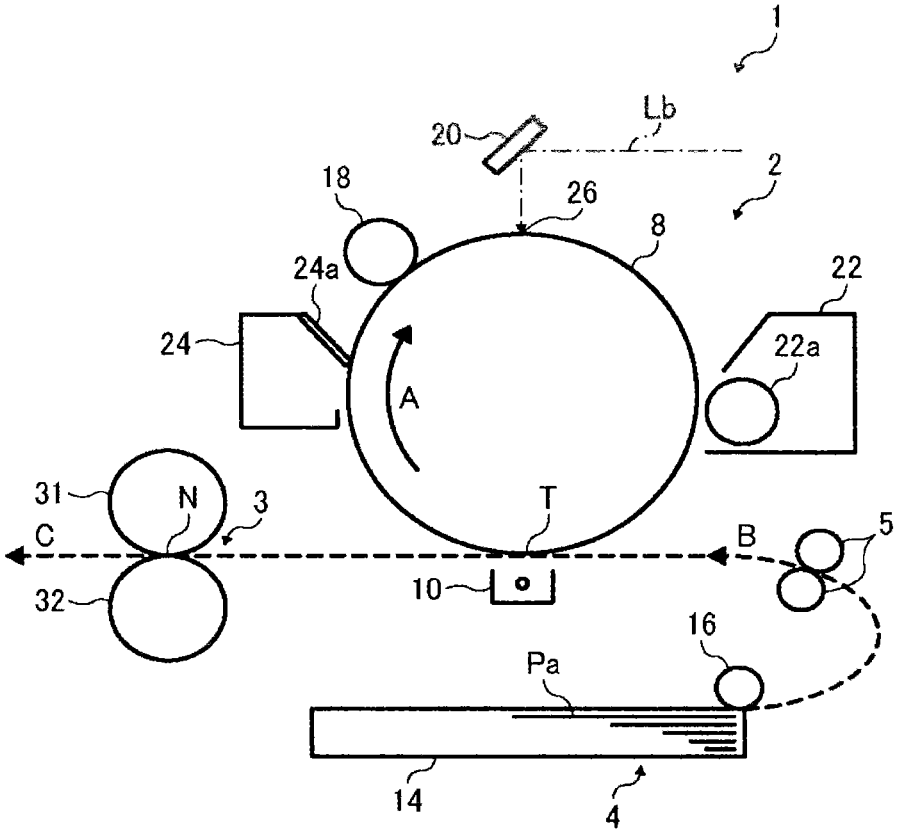
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a printer that forms a monochrome toner image on a recording medium by electrophotography.

With reference to FIG. 1, a description is provided of a construction of the image forming apparatus 1.

The image forming apparatus 1 is a monochrome printer for forming a monochrome toner image on a recording medium by electrophotography. Alternatively, the image forming apparatus 1 may be a color printer for forming a color toner image on a recording medium. The image forming apparatus 1 includes a sheet feeder 4, a registration roller pair 5, an image forming device 2, and a fixing device 3 arranged in this order in sheet conveyance directions B and C.

A detailed description is now given of a construction of the image forming device 2.

The image forming device 2 includes a photoconductive drum 8 serving as an image carrier. The photoconductive drum 8 is surrounded by a charging roller 18 serving as a charger, a mirror 20, a development device 22, a transfer charger 10 serving as a transfer device, and a cleaner 24 (e.g., a cleaning unit), which are arranged in this order in a rotation direction A of the photoconductive drum 8.

The mirror 20, constituting a component of an exposure device, reflects a light beam Lb emitted by the exposure device onto an exposure position 26 on an outer circumferential surface of the photoconductive drum 8 interposed between the charging roller 18 and the development device 22 in the rotation direction A of the photoconductive drum 8, thus forming an electrostatic latent image on the photoconductive drum 8.

The development device 22 contains toner and includes a development roller 22*a* that supplies toner to the outer circumferential surface of the photoconductive drum 8. According to this exemplary embodiment, the development device 22 contains black toner to form a black toner image. Alternatively, the development device 22 may contain toner in other colors, for example, yellow, cyan, magenta, or the like.

The cleaner 24 includes a cleaning blade 24*a* that removes residual toner failed to be transferred onto a sheet Pa and therefore remaining on the photoconductive drum 8 therefrom.

A detailed description is now given of a construction of the fixing device 3.

The fixing device 3 includes a fixing sleeve 31 serving as a tubular fixing rotator made of heat resistant resin, a pressure roller 32 serving as a pressure rotator, and a heater that heats the fixing sleeve 31. The pressure roller 32 is pressed against the fixing sleeve 31 to form a fixing nip N therebetween.

A detailed description is now given of a construction of the sheet feeder 4.

The sheet feeder 4 includes a paper tray 14 that loads a plurality of sheets Pa serving as recording media and a feed roller 16 that picks up and feeds an uppermost sheet Pa of the plurality of sheets Pa loaded in the paper tray 14. A conveyance roller pair conveys the uppermost sheet Pa conveyed from the feed roller 16 to the registration roller pair 5.

A detailed description is now given of a configuration of the registration roller pair 5.

As a leading edge of the uppermost sheet Pa comes into contact with a roller nip of the registration roller pair 5, the registration roller pair 5 halts the sheet Pa temporarily. After the registration roller pair 5 corrects skew of the sheet Pa, the registration roller pair 5 resumes rotation and feeds the sheet Pa in the sheet conveyance direction B to a transfer nip T formed between the photoconductive drum 8 and the transfer charger 10 in synchronism with rotation of the photoconductive drum 8. For example, at a time when a leading edge of the toner image formed on the photoconductive drum 8 corresponds to a predetermined position of the leading edge of the sheet Pa, the sheet Pa enters the transfer nip T.

A description is provided of an image forming operation of the image forming apparatus 1 to form a toner image on a sheet Pa.

As the photoconductive drum 8 starts rotating in the rotation direction A, the charging roller 18 uniformly charges the outer circumferential surface of the photoconductive drum 8. The exposure device emits a laser beam Lb modulated in accordance with image data sent from an external device such as a client computer onto the charged outer circumferential surface of the photoconductive drum 8 at the exposure position 26 thereon. The laser beam Lb scans the photoconductive drum 8 in a main scanning direction parallel to an axial direction of the photoconductive drum 8, thus forming an electrostatic latent image to be visualized into a toner image on the outer circumferential surface of the photoconductive drum 8.

The electrostatic latent image formed on the photoconductive drum 8 moves to a development position disposed opposite the development roller 22*a* of the development device 22 in accordance with rotation of the photoconductive drum 8. At the development position, the development roller 22*a* supplies toner to the electrostatic latent image on the photoconductive drum 8, visualizing the electrostatic latent image into a toner image. The transfer charger 10 applied with a transfer bias transfers the toner image from the photoconductive drum 8 onto a sheet Pa at a predetermined time when the sheet Pa enters the transfer nip T.

The sheet Pa bearing the toner image is conveyed in the sheet conveyance direction B to the fixing device 3. As the sheet Pa is conveyed through the fixing nip N formed between the fixing sleeve 31 and the pressure roller 32, the fixing sleeve 31 and the pressure roller 32 apply heat and pressure to the sheet Pa, fixing the toner image on the sheet Pa. The sheet Pa bearing the fixed toner image is conveyed in the sheet conveyance direction C to an output tray that stacks the sheet Pa.

As residual toner failed to be transferred onto the sheet Pa at the transfer nip T and therefore remaining on the photoconductive drum 8 moves under the cleaner 24 in accordance with rotation of the photoconductive drum 8, the cleaning blade 24*a* of the cleaner 24 scrapes the residual toner off the photoconductive drum 8, thus cleaning the photoconductive drum 8. Thereafter, a discharger (e.g., a discharging lamp) removes residual potential from the photoconductive drum 8, rendering the photoconductive drum 8 to be ready for a next image forming operation.

Figure 2:
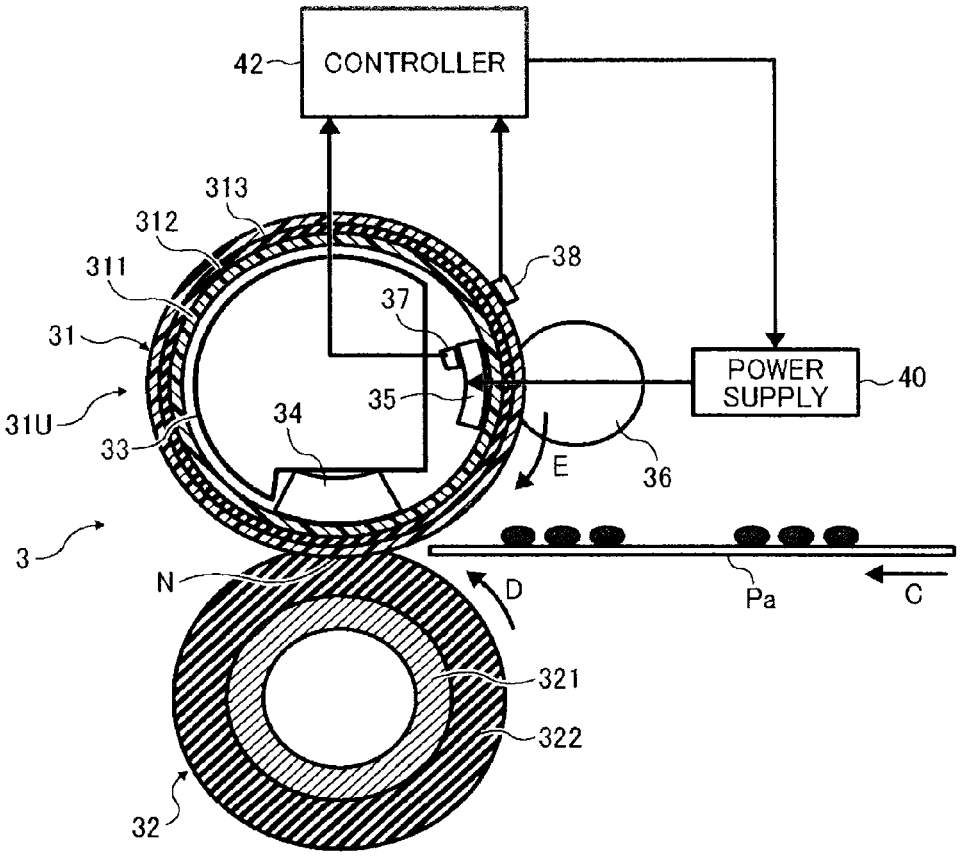
FIG. 2 is a schematic vertical sectional view of a fixing device incorporated in the image forming apparatus shown in FIG. 1.

With reference to FIG. 2, a description is provided of a construction of the fixing device 3 incorporated in the image forming apparatus 1 described above.

FIG. 2 is a schematic vertical sectional view of the fixing device 3 incorporated in the image forming apparatus 1 described above. As shown in FIG. 2, the fixing device 3 (e.g., a fuser) includes the fixing sleeve 31 serving as a tubular fixing rotator rotatable in a rotation direction E and the pressure roller 32 serving as a pressure rotator rotatable in a rotation direction D and pressed against the fixing sleeve 31 to form the fixing nip N therebetween. The fixing sleeve 31 is heated by an interior heater disposed inside a loop formed by the fixing sleeve 31.

A detailed description is now given of a construction of the fixing sleeve 31.

The fixing sleeve 31 is constructed of a base layer 311, an elastic layer 312 coating the base layer 311, and a release layer 313 coating the elastic layer 312. The base layer 311, made of heat resistant resin, for example, polyimide resin, has an outer diameter of about 30 mm and a thickness of about 50 micrometers. The elastic layer 312, made of a heat resistant elastic material, for example, silicone rubber, has a thickness in a range of from about 50 micrometers to about 70 micrometers. The release layer 313, having a thickness in a range of from about 5 micrometers to about 50 micrometers, is made of fluoroplastic such as tetrafluoroethylene-perfluoroalkylvinylether copolymer (PFA) and polytetrafluoroethylene (PTFE) to enhance durability of the fixing sleeve 31 and facilitate separation of toner of the toner image on the sheet Pa from the fixing sleeve 31. Compared to the outer diameter of the fixing sleeve 31, the thickness of each of the base layer 311, the elastic layer 312, and the release layer 313 is substantially small. However, in FIG. 2, the thickness of each of the base layer 311, the elastic layer 312, and the release layer 313 is exaggerated for purposes of illustration. Alternatively, the base layer 311 may be made of metal such as SUS stainless steel and nickel.

Inside the loop formed by the fixing sleeve 31 are a support 33 that supports the fixing sleeve 31 and also serves as a guide that guides the fixing sleeve 31 by contacting an inner circumferential surface of the fixing sleeve 31, a nip formation pad 34 pressing against the pressure roller 32 via the fixing sleeve 31 to form the fixing nip N, and a thermal heater 35 shifted from the fixing nip N in a circumferential direction of the fixing sleeve 31 by about 45 degrees. The thermal heater 35 is a substantially planar heater that heats the fixing sleeve 31. Each of the nip formation pad 34 and the thermal heater 35 has an arcuate outer face in contact with the inner circumferential surface of the fixing sleeve 31. That is, the arcuate outer face of each of the nip formation pad 34 and the thermal heater 35 is curved along the inner circumferential surface of the fixing sleeve 31. The support 33 is formed in substantially a tube constructed of an arch curved along the inner circumferential surface of the fixing sleeve 31, a horizontal plate disposed opposite the nip formation pad 34, and a vertical plate disposed opposite the thermal heater 35. The support 33 is made of heat resistant resin, metal such as stainless steel, or the like.

The support 33, the nip formation pad 34, and the thermal heater 35 are mounted on an exterior of the fixing sleeve 31, for example, a flange described below, to rotatably support the fixing sleeve 31 by contacting the inner circumferential surface of the fixing sleeve 31. The outer face of each of the support 33, the nip formation pad 34, and the thermal heater 35 that contacts the inner circumferential surface of the fixing sleeve 31 may be coated with abrasion resistant fluoroplastic having a decreased friction coefficient such as PFA and PTFE.

Alternatively, instead of the nip formation pad 34, the thermal heater 35 may press against the pressure roller 32 via the fixing sleeve 31 to form the fixing nip N. In this case, the support 33 may be constructed of a U-like arch and a horizontal plate disposed opposite the thermal heater 35 at the fixing nip N. The thermal heater 35 serving as a planar heater is a thermal head or a ceramic heater constructed of a planar base and a resistance heat generator mounted on the base to heat the fixing sleeve 31.

A detailed description is now given of a construction of the pressure roller 32.

The pressure roller 32, having an outer diameter of about 30 mm, is constructed of a core metal 321 and an elastic layer 322 coating the core metal 321. The core metal 321, made of iron, has a thickness of about 2 mm. The elastic layer 322, made of silicone rubber, has a thickness of about 5 mm. A fluoroplastic layer having a thickness of about 40 micrometers may coat the elastic layer 322 to facilitate separation of the sheet Pa from the pressure roller 32.

A resilient pressurization assembly presses the pressure roller 32 against the nip formation pad 34 via the fixing sleeve 31. For example, as the elastic layer 322 of the pressure roller 32 is pressed against the fixing sleeve 31, a part of the elastic layer 322 disposed opposite the nip formation pad 34 deforms throughout an axial span of the pressure roller 32 in an axial direction thereof, forming the fixing nip N having a predetermined length in the rotation direction D of the pressure roller 32. While the pressure roller 32 is pressed against the fixing sleeve 31, a driver drives and rotates the pressure roller 32 counterclockwise in FIG. 2 in the rotation direction D. In accordance with rotation of the pressure roller 32, the fixing sleeve 31 is rotated clockwise in FIG. 2 in the rotation direction E by friction between the fixing sleeve 31 and the pressure roller 32.

A rotatable pressurization roller 36 situated outside the loop formed by the fixing sleeve 31 is disposed opposite the thermal heater 35 via the fixing sleeve 31. A resilient pressurization assembly presses a shaft of the pressurization roller 36 against the fixing sleeve 31, thus pressing the fixing sleeve 31 against the thermal heater 35. At least a portion of the pressurization roller 36 in proximity to an outer circumferential surface thereof has elasticity so that a part of the pressurization roller 36 pressed against the fixing sleeve 31 is pressed and deformed to allow the pressurization roller 36 to rotate in accordance with rotation of the fixing sleeve 31 by friction therebetween.

The thermal heater 35 mounts a thermistor 37 serving as a temperature detector that detects the temperature of the thermal heater 35. The fixing sleeve 31 and the components disposed inside the loop formed by the fixing sleeve 31, that is, the thermal heater 35, the thermistor 37, the support 33, and the nip formation pad 34, may constitute a belt unit 31U separably coupled with the pressure roller 32. Upstream from the thermal heater 35 in the rotation direction E of the fixing sleeve 31 is a thermistor 38 disposed outside the loop formed by the fixing sleeve 31. The thermistor 38, disposed opposite an outer circumferential surface of the fixing sleeve 31, serves as a temperature detector that detects the temperature of the outer circumferential surface of the fixing sleeve 31.

The fixing device 3 further includes a power supply 40 that supplies power to the thermal heater 35 and a controller 42 operatively connected to the power supply 40 and the thermistors 37 and 38 to control the power supply 40 based on the temperature of the thermal heater 35 detected by the thermistor 37 and the temperature of the fixing sleeve 31 detected by the thermistor 38. Alternatively, the controller 42 may be situated inside the image forming apparatus 1 at a position outside the fixing device 3.

A detailed description is now given of a configuration of the controller 42.

The controller 42 (e.g., a processor) is a micro computer including a central processing unit (CPU), a read-only memory (ROM), a random-access memory (RAM), and an input-output (I/O) interface. The controller 42 controls the power supply 40 to adjust an amount of power supplied to the thermal heater 35 so that the temperature of the outer circumferential surface of the fixing sleeve 31 detected by the thermistor 38 maintains a predetermined fixing temperature at which the toner image is fixed on the sheet Pa properly. Thus, the controller 42 controls the temperature of the thermal heater 35 based on the temperature of the thermal heater 35 detected by the thermistor 37.

A sheet Pa bearing an unfixed toner image illustrated by the solid circles in FIG. 2 is conveyed to the fixing nip N formed between the fixing sleeve 31 and the pressure roller 32 pressed against the fixing sleeve 31. As the pressure roller 32 rotating in the rotation direction D and the fixing sleeve 31 rotating in the rotation direction E by friction between the pressure roller 32 and the fixing sleeve 31 sandwich and convey the sheet Pa through the fixing nip N, the fixing sleeve 31 contacting the toner image on the sheet Pa, together with the pressure roller 32, applies heat and pressure to the sheet Pa, fixing the toner image on the sheet Pa. Thereafter, the sheet Pa bearing the fixed toner image is discharged from the fixing nip N leftward in FIG. 2.

Figure 3:
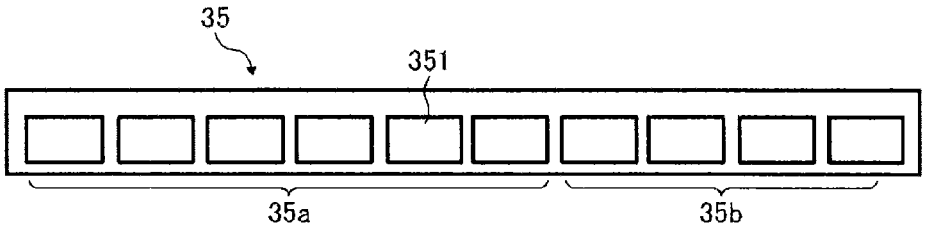
FIG. 3 is a plan view of a thermal heater incorporated in the fixing device shown in FIG. 2.

With reference to FIG. 3, a description is provided of a construction of the thermal heater 35.

FIG. 3 is a plan view of the thermal heater 35. As shown in FIG. 3, the thermal heater 35 includes a plurality of heating portions 351, that is, ten heating portions 351 according to this exemplary embodiment, aligned in an axial direction, that is, a longitudinal direction, of the fixing sleeve 31 perpendicular to the sheet conveyance direction C. The plurality of heating portions 351 constitutes heating spans 35*a* and 35*b* in the axial direction of the fixing sleeve 31. The controller 42 actuates each heating portion 351 independently to heat the fixing sleeve 31 in a variable heating span in the axial direction thereof. For example, the controller 42 controls the power supply 40 to selectively supply power to the heating portions 351 situated in the heating span 35*a* or 35*b*. Alternatively, the controller 42 may control the power supply 40 to supply power to the heating portions 351 situated in the heating span 35*a* in a first amount of power and to the heating portions 351 situated in the heating span 35*b* in a second amount of power different from the first amount of power so as to allow the thermal heater 35 to generate heat in the heating spans 35*a* and 35*b* in different amounts of heat, respectively.

The controller 42 actuates the heating portions 351 of the thermal heater 35 in the heating span 35*a* independently from the heating portions 351 in the heating span 35*b* based on position data of the toner image to be formed on the sheet Pa to allow the heating portions 351 corresponding to a blank area on the sheet Pa to heat the fixing sleeve 31 to a temperature lower than a temperature to which the heating portions 351 corresponding to an image area on the sheet Pa heat the fixing sleeve 31, thus heating the fixing sleeve 31 unevenly in the axial direction thereof.

With reference to FIGS. 4A, 4B, 5A, and 5B, a description is provided of one example of control performed by the controller 42.

Figure 4A:
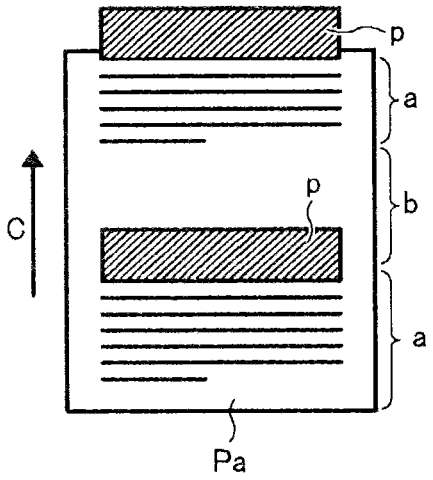
FIG. 4A is a plan view of a sheet conveyed through the fixing device shown in FIG. 2 and having a first image formation pattern.
Figure 4B:
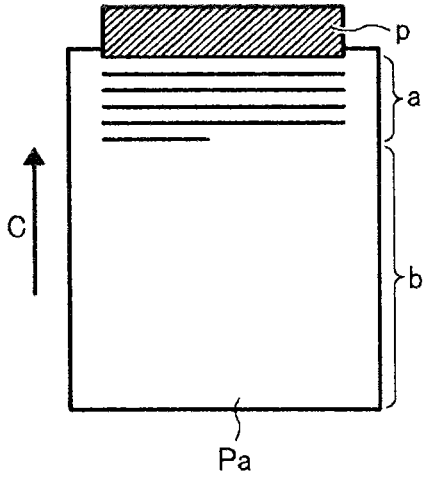
FIG. 4B is a plan view of a sheet conveyed through the fixing device shown in FIG. 2 and having a second image formation pattern.

FIG. 4A is a plan view of the sheet Pa having a first image formation pattern. FIG. 4A illustrates the first image formation pattern having an image area a, a blank area b, and an image area a arranged on the sheet Pa in this order from a leading edge to a trailing edge of the sheet Pa in the sheet conveyance direction C. FIG. 4B is a plan view of the sheet Pa having a second image formation pattern. FIG. 4B illustrates the second image formation pattern having an image area a and a blank area b arranged on the sheet Pa in this order from the leading edge to the trailing edge of the sheet Pa in the sheet conveyance direction C.

The blank area b is greater than the image area a. The image area a, as it bears the toner image, needs fixing of the toner image on the sheet Pa. Conversely, the blank area b, as it does not bear the toner image, does not need fixing of the toner image on the sheet Pa.

As an image processor sends image data having the first image formation pattern shown in FIG. 4A or the second image formation pattern shown in FIG. 4B to the controller 42, the controller 42 performs a control below. As shown in FIGS. 2 and 3, the controller 42 controls the thermal heater 35 to cause the heating portions 351 disposed opposite a blank region on the fixing sleeve 31 corresponding to the blank area b on the sheet Pa to heat the fixing sleeve 31 to a decreased temperature and cause the heating portions 351 disposed opposite an image region on the fixing sleeve 31 corresponding to the image area a on the sheet Pa to heat the fixing sleeve 31 to an increased temperature higher than the decreased temperature. The blank region on the fixing sleeve 31 adheres to the blank area b on the sheet Pa conveyed through the fixing nip N; the image region on the fixing sleeve 31 adheres to the image area a on the sheet Pa conveyed through the fixing nip N.

For example, when the image area a on the sheet Pa is conveyed through the fixing nip N, the controller 42 controls the power supply 40 to supply power to the thermal heater 35 in an increased amount great enough to allow the heating portions 351 to heat the fixing sleeve 31 to the fixing temperature throughout the entire span in the axial direction thereof. Conversely, when the blank area b on the sheet Pa is conveyed through the fixing nip N, the controller 42 controls the power supply 40 to supply power to the thermal heater 35 in a decreased amount great enough to allow the heating portions 351 to heat the fixing sleeve 31 to a temperature lower than the fixing temperature. When the image area a in proximity to the trailing edge of the sheet Pa is conveyed through the fixing nip N, the controller 42 controls the power supply 40 to supply power to the thermal heater 35 in the increased amount great enough to allow the heating portions 351 to heat the fixing sleeve 31 to the fixing temperature throughout the entire span in the axial direction thereof.

The controller 42 controls the power supply 40 to supply power to the thermal heater 35 such that the thermal heater 35 preliminarily heats a preliminary heating region on the fixing sleeve 31 corresponding to a preliminary heating area p indicated by shading in FIGS. 4A and 4B on the sheet Pa or spanning across the leading edge of the sheet Pa in the sheet conveyance direction C. The preliminary heating area p on the sheet Pa enters the fixing nip N before the image area a on the sheet Pa does. The preliminary heating area p is provided in view of a circumferential heat generation span of the thermal heater 35 in a circumferential direction thereof and a time needed for the heating portions 351 to heat themselves. The preliminary heating area p may be as small as feasible in view of energy saving.

Figure 5A:
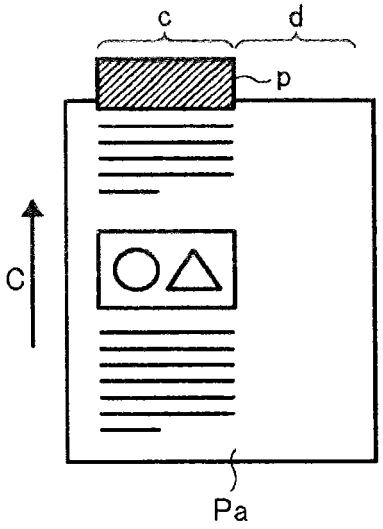
FIG. 5A is a plan view of a sheet conveyed through the fixing device shown in FIG. 2 and having a third image formation pattern.

FIG. 5A is a plan view of the sheet Pa having a third image formation pattern. FIG. 5A illustrates the third image formation pattern having an image area c and a blank area d arranged on the sheet Pa in the axial direction of the fixing sleeve 31 perpendicular to the sheet conveyance direction C. Like the sheet Pa having the first and second image formation patterns shown in FIGS. 4A and 4B, respectively, the controller 42 controls the thermal heater 35 to heat the fixing sleeve 31 unevenly such that a temperature of a blank region on the fixing sleeve 31 corresponding to the blank area d on the sheet Pa is lower than a temperature of an image region on the fixing sleeve 31 corresponding to the image area c on the sheet Pa.

For example, the controller 42 controls the power supply 40 to supply power to the heating portions 351 in the heating span 35*a* depicted in FIG. 3 that are disposed opposite the image region on the fixing sleeve 31 corresponding to the image area c on the sheet Pa in an increased amount great enough to heat the fixing sleeve 31 to the fixing temperature. Conversely, the controller 42 controls the power supply 40 to supply power to the heating portions 351 in the heating span 35*b* depicted in FIG. 3 that are disposed opposite the blank region on the fixing sleeve 31 corresponding to the blank area d on the sheet Pa in a decreased amount great enough to heat the fixing sleeve 31 to a temperature lower than the fixing temperature. In this case also, the thermal heater 35 heats the fixing sleeve 31 in a region thereon corresponding to the preliminary heating area p on the sheet Pa.

Figure 5B:
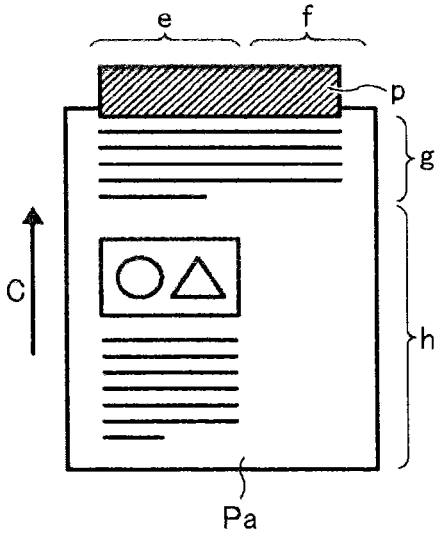
FIG. 5B is a plan view of a sheet conveyed through the fixing device shown in FIG. 2 and having a fourth image formation pattern.

FIG. 5B is a plan view of the sheet Pa having a fourth image formation pattern. FIG. 5B illustrates the fourth image formation pattern having axial image spans e and fin the axial direction of the fixing sleeve 31. The axial image span e includes image areas g and h arranged in the sheet conveyance direction C. The axial image span f includes the image area g and does not include the image area h. That is, the axial image span f includes a blank area adjacent to the image area h in the axial direction of the fixing sleeve 31.

The controller 42 may prohibit the power supply 40 from supplying power to the heating portions 351 disposed opposite the blank regions on the fixing sleeve 31 corresponding to the blank area b and the blank area adjacent to the image area h in the axial direction of the fixing sleeve 31. However, if the temperature of the fixing sleeve 31 is lowered excessively, the fixing sleeve 31 has not been heated to the fixing temperature when the subsequent image area a, c, g, or h on the sheet Pa comes into contact with the fixing sleeve 31. To address this circumstance, the controller 42 controls the thermal heater 35 to retain the fixing sleeve 31 at a second target temperature that is lower than a first target temperature equivalent to the fixing temperature and higher than an ambient temperature by a predetermined temperature or more. Thus, although the power supply 40 supplies power to the heating portions 351 disposed opposite the blank region on the fixing sleeve 31 corresponding to the blank area b or d on the sheet Pa, the power supply 40 supplies a reduced amount of power to the heating portions 351, saving energy.

A description is provided of movement of the thin fixing sleeve 31.

A fixing sleeve including a metal layer, even if it is skewed in an axial direction thereof as it rotates and therefore a lateral end of the fixing sleeve in the axial direction thereof comes into contact with a support that rotatably supports the fixing sleeve, the fixing sleeve is immune from buckling due to rigidity of the metal layer, attaining stable movement or rotation of the fixing sleeve. Conversely, a thin fixing belt made of polyimide resin is stretched taut across a plurality rollers to prevent buckling of a center of the fixing belt in an axial direction thereof. However, if the entire fixing belt is skewed in the axial direction thereof, one lateral end of the fixing belt in the axial direction thereof may come into contact with a support that supports the fixing belt, resulting in buckling or breakage of the fixing belt.

To address this circumstance, a skew restraint (e.g., a flange) made of silicone rubber is situated inside the fixing belt at each lateral end of the fixing belt in the axial direction thereof such that the flange abuts a lateral end of each of the plurality of rollers across which the fixing belt is stretched. Thus, the flange prevents skew of the fixing belt. However, as shown in FIG. 2, the stationary components such as the support 33, the nip formation pad 34, the thermal heater 35, and the thermistor 37 are located inside the loop formed by the fixing sleeve 31. Since those stationary components do not rotate in accordance with rotation of the fixing sleeve 31, the skew restraint may not abut the stationary components. Additionally, since the fixing sleeve 31 has a decreased loop diameter of about 30 mm, if the skew restraint is located inside the loop formed by the fixing sleeve 31, the skew restraint may decrease a space inside a hollow tube of the fixing sleeve 31, obstructing installation of the stationary components inside the fixing sleeve 31.

Figure 6:
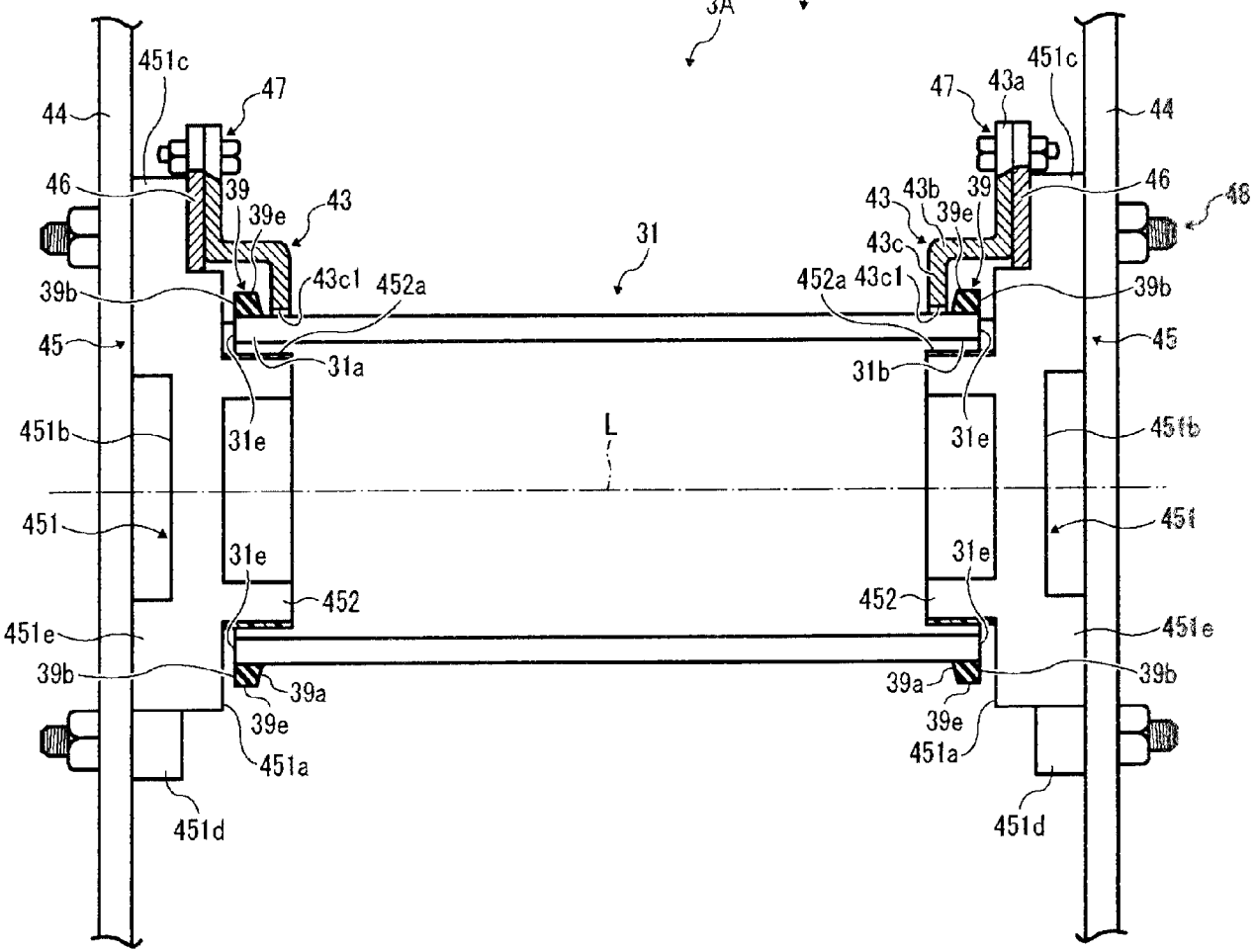
FIG. 6 is a partial sectional side view of the fixing device shown in FIG. 2 illustrating a fixing sleeve, a skew restraint, a stopper, and a flange incorporated therein.
Figure 7:
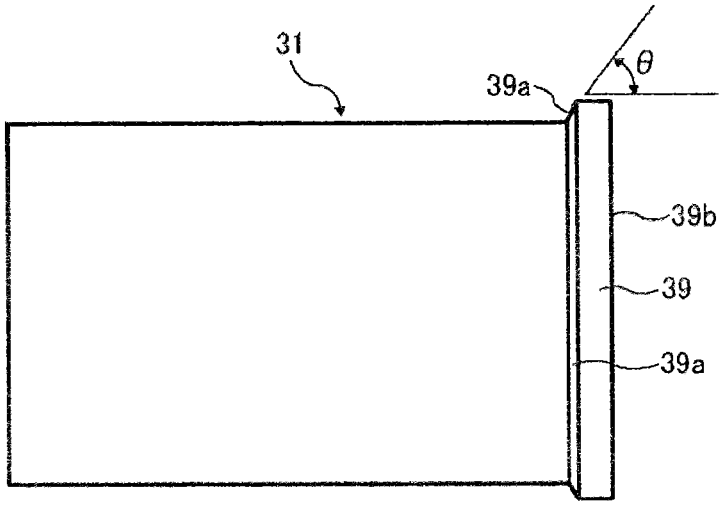
FIG. 7 is a partial side view of the fixing sleeve and the skew restraint shown in FIG. 6.
Figure 8:
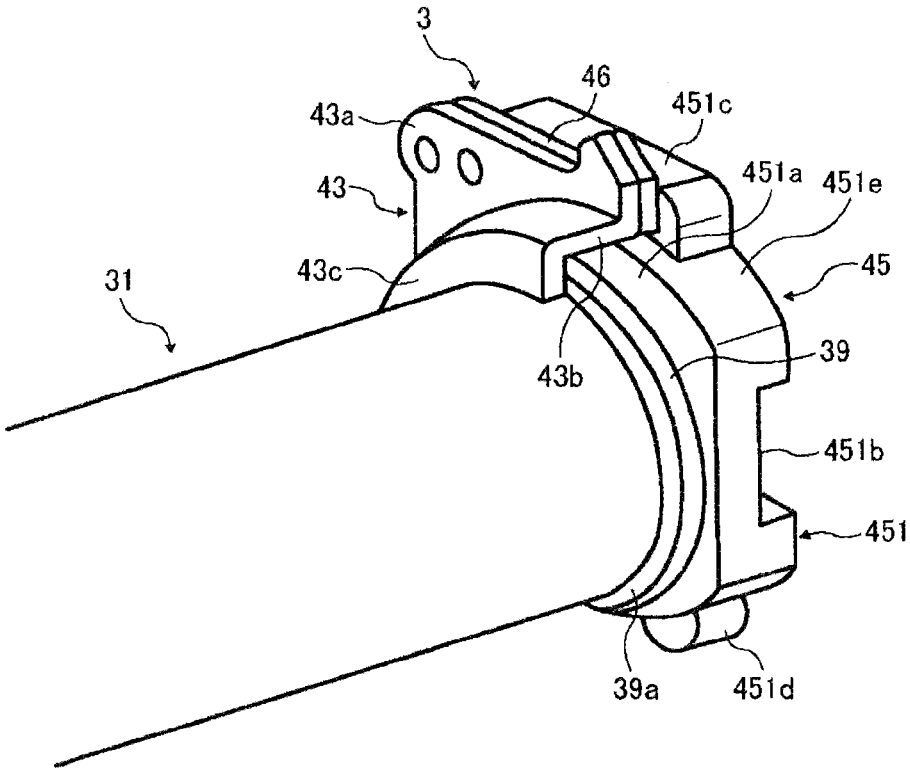
FIG. 8 is a partial perspective view of the fixing sleeve, the skew restraint, the stopper, and the flange shown in FIG. 6.

With reference to FIGS. 6 to 8, a description is provided of a configuration of the fixing device 3 to prevent skew of the fixing sleeve 31.

FIG. 6 is a partial sectional side view of the fixing device 3. FIG. 7 is a partial side view of the fixing sleeve 31. FIG. 8 is a partial perspective view of the fixing sleeve 31. As shown in FIG. 6, the fixing device 3 further includes two skew restraints 39, that is, a first skew restraint and a second skew restraint, mounted on and projecting from the outer circumferential surface of the fixing sleeve 31 at both lateral ends 31*a* and 31*b*, that is, a first lateral end and a second lateral end, of the fixing sleeve 31 in the axial direction parallel to an axis L thereof, respectively. The skew restraint 39 is a ring made of a heat resistant elastic material such as silicone rubber and adheres to the outer circumferential surface of the fixing sleeve 31, preferably on an outer circumferential surface of the base layer 311 shown in FIG. 2, at each of the lateral ends 31*a* and 31*b*, with an adhesive throughout the entire circumference of the fixing sleeve 31.

A pair of flanges 45 serving as a pair of supports is mounted on a predetermined position of a pair of side plates 44, that is, a first support and a second support, of the fixing device 3, respectively. The flanges 45 rotatably support the fixing sleeve 31 at both lateral ends 31*a* and 31*b* in the axial direction of the fixing sleeve 31, respectively. Stoppers 43, that is, a first stopper and a second stopper, are attached to the flanges 45, respectively, such that the skew restraints 39 mounted on the fixing sleeve 31 at both lateral ends 31*a* and 31*b* thereof are situated outboard from the stoppers 43 in the axial direction of the fixing sleeve 31. As the fixing sleeve 31 is skewed in the axial direction thereof and the skew restraint 39 comes into contact with the stopper 43, the stopper 43 prohibits the skew restraint 39 from moving farther in the axial direction of the fixing sleeve 31, thus preventing farther skew of the fixing sleeve 31 in the axial direction thereof.

A detailed description is now given of a construction of each flange 45.

Each flange 45 includes a flange portion 451 and a tube 452. The flange portion 451 includes a flange face 451*a* disposed opposite a lateral edge face 31*e* of the fixing sleeve 31 and an outboard face 39*b*, that is, a lateral edge face, of the skew restraint 39. As the fixing sleeve 31 moves in the axial direction thereof, the lateral edge face 31*e* of the fixing sleeve 31 and the outboard face 39*b* of the skew restraint 39 come into contact with the flange face 451*a* of the flange portion 451 of the flange 45. The flange portion 451 is fastened to the side plate 44 with a fastener 48 such as a bolt and a nut. Each tube 452 projects from the flange face 451*a* of the flange portion 451 inboard toward a center of the fixing sleeve 31 in the axial direction thereof. The tubes 452 are inserted into the fixing sleeve 31 at both lateral ends 31*a* and 31*b* thereof, respectively. An outer circumferential surface of the tube 452 that may come into contact with the inner circumferential surface of the fixing sleeve 31 is treated with a coating 452*a* made of abrasion resistant fluoroplastic having a decreased friction coefficient such as PFA and PTFE.

The tube 452 is contoured into a circle or an ellipse in cross-section at a portion other than portions disposed opposite the nip formation pad 34 and the thermal heater 35 depicted in FIG. 2. An outer diameter of the tube 452 is slightly smaller than an inner diameter of the fixing sleeve 31. Accordingly, the tubes 452 inserted into the fixing sleeve 31 at both lateral ends 31*a* and 31*b* thereof, respectively, rotatably support and guide the fixing sleeve 31 while retaining the substantially circular shape of the fixing sleeve 31. Hence, a center of the circular tube 452 is identical to the axis L of the fixing sleeve 31. Although not illustrated in FIG. 6, the support 33 shown in FIG. 2 may be mounted on or molded with the tubes 452 of the flanges 45.

The flanges 45 also support both lateral ends of the nip formation pad 34 and the thermal heater 35 in a longitudinal direction thereof, respectively. Power supply wiring of the thermal heater 35 and signal wiring of the thermistor 37 are electrically connected to the power supply 40 and the controller 42 through slots produced in one of the flanges 45 and one of the side plates 44.

As shown in FIGS. 6 and 8, the flange portion 451 of the flange 45 includes a body 451*e*, a notch 451*b* produced in a side face of the body 451*e*, and a great mount 451*c* and a small mount 451*d* substantially symmetrically mounted on and molded with an outer circumferential face of the body 451*e*. As shown in FIG. 6, the great mount 415*c* mounts a mount plate 46 mounting the stopper 43. For example, a base 43*a* of the stopper 43 is fastened to the mount plate 46 with a fastener 47 such as a bolt and a nut. As shown in FIGS. 6 and 8, the stopper 43 is an arch bent into a crank relative to the axial direction of the fixing sleeve 31 and made of metal or rigid heat resistant resin. The stopper 43 further includes a bridge 43*b* projecting from the base 43*a* and a stopper portion 43*c* projecting from the bridge 43*b*. For example, the bridge 43*b* projects from the base 43*a* inboard toward the center of the fixing sleeve 31 in the axial direction thereof and is in parallel to the outer circumferential surface of the fixing sleeve 31 with a predetermined interval therebetween. The stopper portion 43*c*, projecting from an inboard edge of the bridge 43*b* toward the outer circumferential surface of the fixing sleeve 31, is an arch curved along the outer circumferential surface of the fixing sleeve 31. As shown in FIG. 6, the stopper portion 43*c* projects from the bridge 43*b* orthogonally toward the outer circumferential surface of the fixing sleeve 31. The stopper portion 43*c* overlaps the skew restraint 39 in a radial direction of the fixing sleeve 31 such that a front edge 43*c*1 of the stopper portion 43*c* is closer to the outer circumferential surface of the fixing sleeve 31 than an outer circumferential edge 39*e* of the skew restraint 39.

As shown in FIG. 7, the skew restraint 39 includes the outboard face 39*b* disposed opposite the flange face 451*a* of the flange portion 451 and an inboard face 39*a* disposed opposite the stopper portion 43*c* of the stopper 43. The outboard face 39*b* is formed in a planar ring. Conversely, the inboard face 39*a* is formed in a conical slope having an outer diameter that increases from an inboard to an outboard of the skew restraint 39 in the axial direction of the fixing sleeve 31. The inboard face 39*a* is angled relative to the axial direction of the fixing sleeve 31 by an angle θ of about 60 degrees.

As shown in FIGS. 6 and 8, the skew restraint 39 mounted on the outer circumferential surface of the fixing sleeve 31 at each of the lateral ends 31*a* and 31*b* thereof is interposed between the stopper portion 43*c* of the stopper 43 and the flange face 451*a* of the flange 45. As shown in FIG. 6, the tube 452 of the flange 45 situated inside the loop formed by the fixing sleeve 31 is disposed opposite the stopper 43 and the skew restraint 39 via the fixing sleeve 31.

The tube 452 that comes into contact with the inner circumferential surface of the fixing sleeve 31 guides the fixing sleeve 31, thus regulating rotation orbit of the fixing sleeve 31. Accordingly, when the fixing sleeve 31 is skewed in the axial direction thereof toward one of the flanges 45, the sloped inboard face 39*a* of the skew restraint 39 situated in proximity to another one of the flanges 45 comes into contact with the stopper portion 43*c* of the stopper 43 precisely. For example, if the fixing sleeve 31 moves in the axial direction thereof toward one of the flanges 45 in proximity to one lateral end 31*a* of the fixing sleeve 31, the skew restraint 39 mounted on another lateral end 31*b* of the fixing sleeve 31 comes into contact with the stopper 43 as the fixing sleeve 31 moving in the axial direction thereof pulls the skew restraint 39 toward the stopper 43, prohibiting farther movement of the fixing sleeve 31. Consequently, the lateral end 31*a* of the fixing sleeve 31 is immune from buckling and further skew.

Thereafter, even if the fixing sleeve 31 moves in the axial direction thereof farther, the lateral edge face 31*e* of the lateral end 31*a* of the fixing sleeve 31 and the outboard face 39*b* of the skew restraint 39 come into contact with the flange face 451*a* of the flange 45. Thus, the flange 45 halts the fixing sleeve 31 and the skew restraint 39, preventing farther movement of the fixing sleeve 31. In this case also, the skew restraint 39 mounted on the lateral end 31*b* of the fixing sleeve 31 abuts the stopper portion 43*c* of the stopper 43 as the fixing sleeve 31 moving in the axial direction thereof pulls the skew restraint 39 toward the stopper 43, prohibiting farther movement of the fixing sleeve 31. Consequently, the lateral end 31*a* of the fixing sleeve 31 is immune from buckling. The stopper 43 is secured to the flange 45 through the mount plate 46. Accordingly, dimensional variation of the stopper 43 and the flange 45 is reduced during assembly of the fixing device 3. Consequently, the skew restraint 39 is positioned relative to the stopper 43 precisely.

As shown in FIG. 7, the inboard face 39*a* of the skew restraint 39 that comes into contact with the stopper portion 43*c* of the stopper 43 is sloped. The angle θ of the sloped inboard face 39*a* is modified to adjust an abutment force exerted between the skew restraint 39 and the stopper 43, preventing the skew restraint 39 from surmounting the stopper 43 and being damaged.

With the construction of the fixing device 3 described above, even when the fixing sleeve 31 rotates at high speed, the fixing sleeve 31 is immune from damage or breakage caused by skew of the fixing sleeve 31, resulting in stable operation of the fixing device 3 incorporated in the image forming apparatus 1. Even if the fixing device 3 is installed in the high speed image forming apparatus 1, the fixing device 3 performs precise fixing operation constantly, saving energy.

Figure 9:
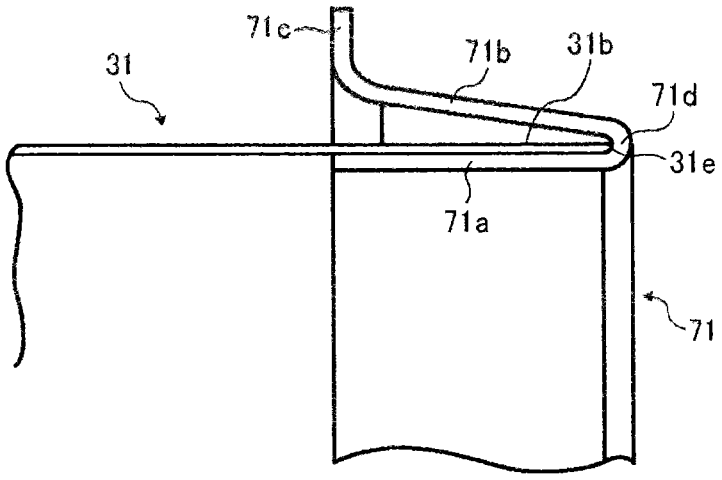
FIG. 9 is a partial perspective view of the fixing sleeve and a variation of the skew restraint shown in FIG. 7.
Figure 10:
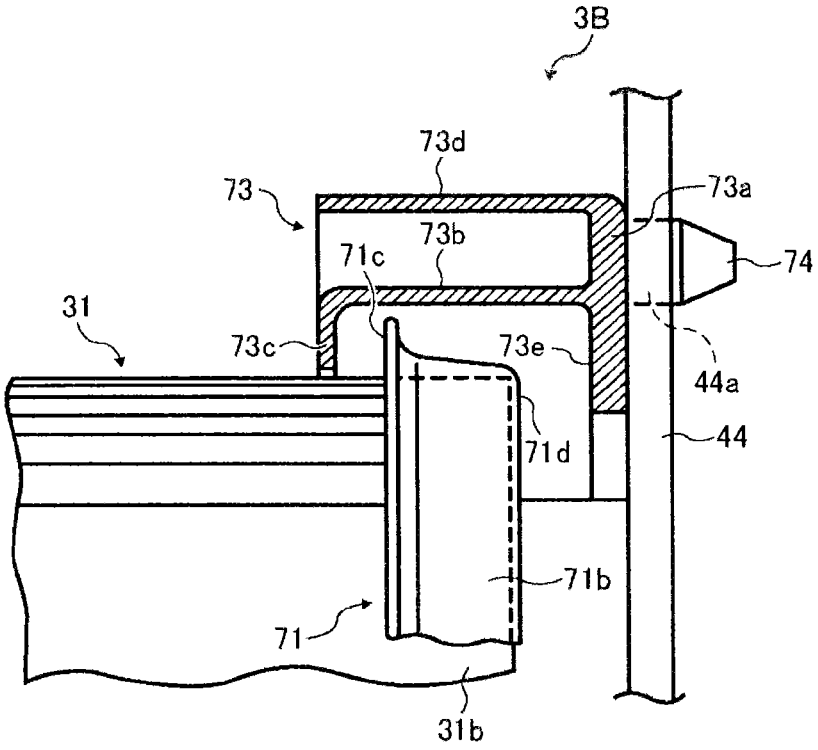
FIG. 10 is a partial side view of the fixing sleeve and the skew restraint shown in FIG. 9 and a variation of the stopper shown in FIG. 6.
Figure 11:
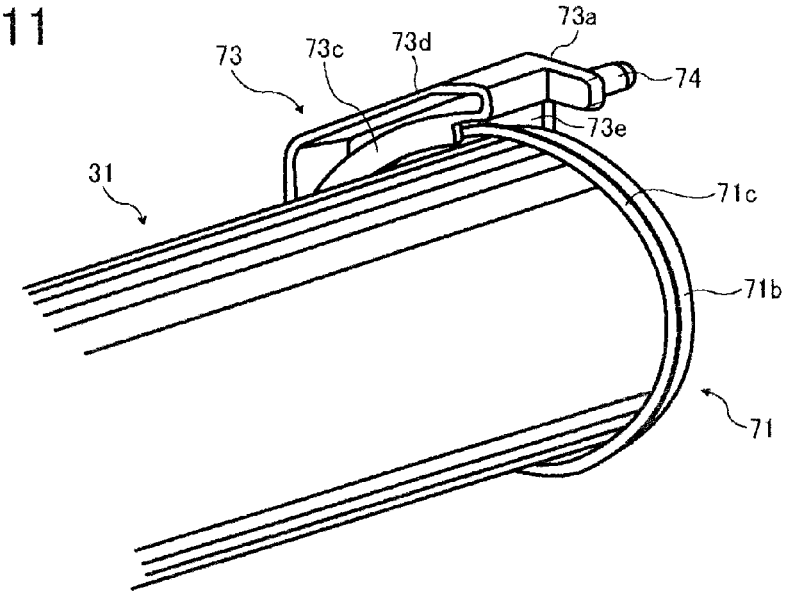
FIG. 11 is a partial perspective view of the fixing sleeve, the skew restraint, and the stopper shown in FIG. 10.

With reference to FIGS. 9 to 11, a description is provided of a variation of the skew restraint 39 and the stopper 43.

FIG. 9 is a partial perspective view of the fixing sleeve 31 illustrating one lateral end in the axial direction thereof. FIG. 10 is a partial side view of the fixing sleeve 31 illustrating one lateral end in the axial direction thereof. FIG. 11 is a partial perspective view of the fixing sleeve 31 illustrating one lateral end in the axial direction thereof. It is to be noted that identical reference numerals are assigned to components shown in FIGS. 9 to 11 that are identical to the components shown in FIGS. 6 to 8. FIGS. 9 to 11 illustrate one lateral end 31*b* of the fixing sleeve 31, omitting illustration of another lateral end 31*a* of the fixing sleeve 31. As shown in FIGS. 9 to 11, like the skew restraint 39 shown in FIGS. 6 to 8, a skew restraint 71 projects from the outer circumferential surface of the fixing sleeve 31.

As shown in FIG. 9, the skew restraint 71 includes an adhesive tube 71*a* serving as an interior portion, an outer circumferential wall 71*b* serving as an exterior portion, and a folding 71*d* disposed opposite the lateral edge face 31*e* of the fixing sleeve 31 and bridging the adhesive tube 71*a* and the outer circumferential wall 71*b*. The adhesive tube 71*a*, the outer circumferential wall 71*b*, and the folding 71*d* are integrally molded. The skew restraint 71 is folded at the folding 71*d* constituting a bottom edge of the skew restraint 71. The outer circumferential wall 71*b* is slightly widened into a cone as shown in FIG. 10. The skew restraint 71 has a V-shape in cross-section as shown in FIG. 9 and is formed in a ring coated with heat resistant resin entirely. A brim 71*c* projects radially from a free end of the outer circumferential wall 71*b*. The skew restraint 71 is made of abrasion resistant fluoroplastic having a decreased friction coefficient such as PTFE and PFA or resin coating containing such fluoroplastic that facilitates sliding of the skew restraint 71. Although the skew restraint 71 is thicker than the fixing sleeve 31, it is flexible. As shown in FIG. 9, the lateral end 31*b* of the fixing sleeve 31 is inserted into a V-shaped gap between the adhesive tube 71*a* and the outer circumferential wall 71*b* until the lateral edge face 31*e* of the fixing sleeve 31 contacts the folding 71*d*. The adhesive tube 71*a* is adhered to the inner circumferential surface of the fixing sleeve 31 with a heat resistant adhesive. Thus, the adhesive tube 71*a* is mounted on the fixing sleeve 31.

As shown in FIGS. 10 and 11, a stopper 73 is attached to the side plate 44 at a position in proximity to the outer circumferential wall 71*b* of the skew restraint 71. The stopper 73 includes a base 73*a*, an inner wall 73*b*, an outer wall 73*d*, and a stopper portion 73*c*. The inner wall 73*b* and the outer wall 73*d* project from the base 73*a* in the axial direction of the fixing sleeve 31 and extend in parallel to each other with an interval therebetween. Thus, the stopper 73 is formed in an arcuate box. The stopper portion 73*c* projects from an inboard edge of the inner wall 73*b* orthogonally toward the outer circumferential surface of the fixing sleeve 31. The stopper portion 73*c* is an arch curved along the outer circumferential surface of the fixing sleeve 31 and disposed opposite the brim 71*c* of the skew restraint 71.

As shown in FIGS. 10 and 11, a plurality of positioning pins 74 projects outboard from an outboard face of the base 73*a* of the stopper 73 in the axial direction of the fixing sleeve 31. It is to be noted that FIGS. 10 and 11 illustrate a single positioning pin 74. As shown in FIG. 10, the positioning pin 74 is inserted into a positioning through-hole 44*a* produced through the side plate 44. Thus, the stopper 73 is positioned with respect to the side plate 44. The positioning pin 74 is secured to the side plate 44 with a fastener. The stopper 73 further includes an arcuate, receiver face 73*e* contiguously molded with the base 73*a* and separably abutted by the folding 71*d* of the skew restraint 71. The side plates 44 rotatably support the fixing sleeve 31.

As shown in FIGS. 10 and 11, the skew restraint 71 projecting radially from the outer circumferential surface of the fixing sleeve 31 is interposed between the stopper portion 73*c* and the receiver face 73*e* of the stopper 73. Although not shown in FIGS. 10 and 11, the components of the skew restraint 71 and the stopper 73 situated at one lateral end 31*b* of the fixing sleeve 31 shown in FIGS. 10 and 11 are also provided at another lateral end 31*a* of the fixing sleeve 31 symmetrically with those provided at the lateral end 31*b* of the fixing sleeve 31.

As described above with reference to FIG. 2, the support 33 serving as a support that supports the fixing sleeve 31 and a guide that guides the fixing sleeve 31, the nip formation pad 34, the thermal heater 35 serving as a planar heater, and the like are installed inside the loop formed by the fixing sleeve 31. Both lateral ends of those components are supported by the side plates 44, respectively. Alternatively, the components inside the fixing sleeve 31 may be supported by the side plates 44 through the flanges 45 depicted in FIG. 6, respectively. A support that guides the fixing sleeve 31 and the skew restraint 71 mounted thereon during rotation, for example, the support 33, may be disposed opposite the inner circumferential surface of the fixing sleeve 31 at least at a position disposed opposite the stopper 73.

In this case also, as one lateral end 31*a* of the fixing sleeve 31 moves in the axial direction thereof toward one of the side plates 44, the brim 71*c* of the skew restraint 71 mounted on another lateral end 31*b* of the fixing sleeve 31 abuts the stopper portion 73*c* of the stopper 73 as the fixing sleeve 31 moving in the axial direction thereof pulls the skew restraint 71 toward the stopper portion 73*c* of the stopper 73, prohibiting farther movement of the fixing sleeve 31. Consequently, the lateral end 31*a* of the fixing sleeve 31 is immune from buckling and farther movement or skew in the axial direction of the fixing sleeve 31. The support for supporting the fixing sleeve 31 by contacting the inner circumferential surface of the fixing sleeve 31 guides the fixing sleeve 31, thus regulating rotation orbit of the fixing sleeve 31. Accordingly, when the fixing sleeve 31 is skewed in the axial direction thereof toward one of the side plates 44, the brim 71*c* of the skew restraint 71 in proximity to another one of the side plates 44 comes into contact with the stopper portion 73*c* of the stopper 73 precisely.

Thereafter, even if the fixing sleeve 31 moves in the axial direction thereof farther, the folding 71*d* of the skew restraint 71 mounted on one lateral end 31*a* of the fixing sleeve 31 comes into contact with the receiver face 73*e* of the stopper 73. Thus, the receiver face 73*e* of the stopper 73 halts the fixing sleeve 31, preventing farther movement of the fixing sleeve 31. In this case also, the skew restraint 71 mounted on another lateral end 31*b* of the fixing sleeve 31 abuts the stopper portion 73*c* of the stopper 73 as the fixing sleeve 31 moving in the axial direction thereof pulls the skew restraint 71 toward the stopper 73, prohibiting farther movement of the fixing sleeve 31. Consequently, the lateral end 31*a* of the fixing sleeve 31 is immune from buckling.

The stopper 73 is secured to the side plate 44. Accordingly, the skew restraints 71 are positioned relative to the stoppers 73 precisely at both lateral ends 31*a* and 31*b* of the fixing sleeve 31, respectively. The adhesive tube 71*a* of the skew restraint 71 is adhered to the inner circumferential surface of the fixing sleeve 31 at each of the lateral ends 31*a* and 31*b* of the fixing sleeve 31. However, since the skew restraint 71 is slidable readily, even if it comes into contact with the stopper 73 or a support inside the loop formed by the fixing sleeve 31, that is, the support 33 depicted in FIG. 2, the skew restraint 71 slides over the stopper 73 and the support with reduced friction therebetween.

Since the skew restraint 71 is a ring coated with a thin, elastic resin film, the skew restraint 71 attains flexibility to conform to deformation of the fixing sleeve 31 caused by rotation. The skew restraint 71 may be made of an elastic material having an increased friction coefficient such as rubber to conform to deformation of the fixing sleeve 31 caused by rotation. However, as the skew restraint 71 comes into contact with the stopper 73 or the support inside the fixing sleeve 31 (e.g., the support 33 depicted in FIG. 2), the elastic material having the increased friction coefficient may increase friction between the skew restraint 71 and the stopper 73 and between the skew restraint 71 and the support inside the fixing sleeve 31.

Accordingly, while the frictional skew restraint 71 prohibits rotation of the fixing sleeve 31 at the lateral end 31*a* or 31*b* thereof, the pressure roller 32 drives and rotates the fixing sleeve 31 at the center in the axial direction thereof. Consequently, the fixing sleeve 31 may be twisted and broken. To address this circumstance, according to this exemplary embodiment, the slidable skew restraint 71, even if it comes into contact with the stopper 73, suppresses friction therebetween, preventing the fixing sleeve 31 from being twisted and broken.

Since the skew restraint 71 is adhered to the inner circumferential surface of the fixing sleeve 31, the fixing sleeve 31 is manufactured simply. For example, the skew restraint 39 depicted in FIGS. 6 to 8 adheres to the outer circumferential surface of the fixing sleeve 31. Hence, in order to adhere the skew restraint 39 to the fixing sleeve 31 precisely, at both lateral ends 31*a* and 31*b* of the fixing sleeve 31, it is necessary to expose the base layer 311 without being coated with the elastic layer 312 and the release layer 313 depicted in FIG. 2. Accordingly, it is necessary to treat both lateral ends 31*a* and 31*b* of the fixing sleeve 31 with masking or the like, complicating processing and increasing manufacturing costs. Conversely, with the skew restraint 71 adhering to the inner circumferential surface of the fixing sleeve 31, since the base layer 311 constitutes the inner circumferential surface of the fixing sleeve 31, even if the base layer 311 mounts the elastic layer 312 and the release layer 313, masking is not needed.

With the construction of the fixing device 3 described above, even when the fixing sleeve 31 rotates at high speed, the fixing sleeve 31 is immune from skew and resultant breakage, attaining stable fixing operation performed by the fixing device 3 installed in the image forming apparatus 1. That is, even if the fixing device 3 is installed in the high speed image forming apparatus 1, the fixing device 3 performs precise fixing operation constantly, saving energy.

As shown in FIG. 6, the fixing device 3 may include a belt device 3A incorporating the fixing sleeve 31 serving as an endless belt, the skew restraints 39, the stoppers 43, the flanges 45, and the side plates 44. Similarly, as shown in FIG. 10, the fixing device 3 may include a belt device 3B incorporating the fixing sleeve 31 serving as an endless belt, the skew restraints 71, the stoppers 73, and the side plates 44. The belt devices 3A and 3B may be installed in devices incorporated in the image forming apparatus 1 other than the fixing device 3 or other apparatuses employing a rotatable endless belt.

Figure 12:
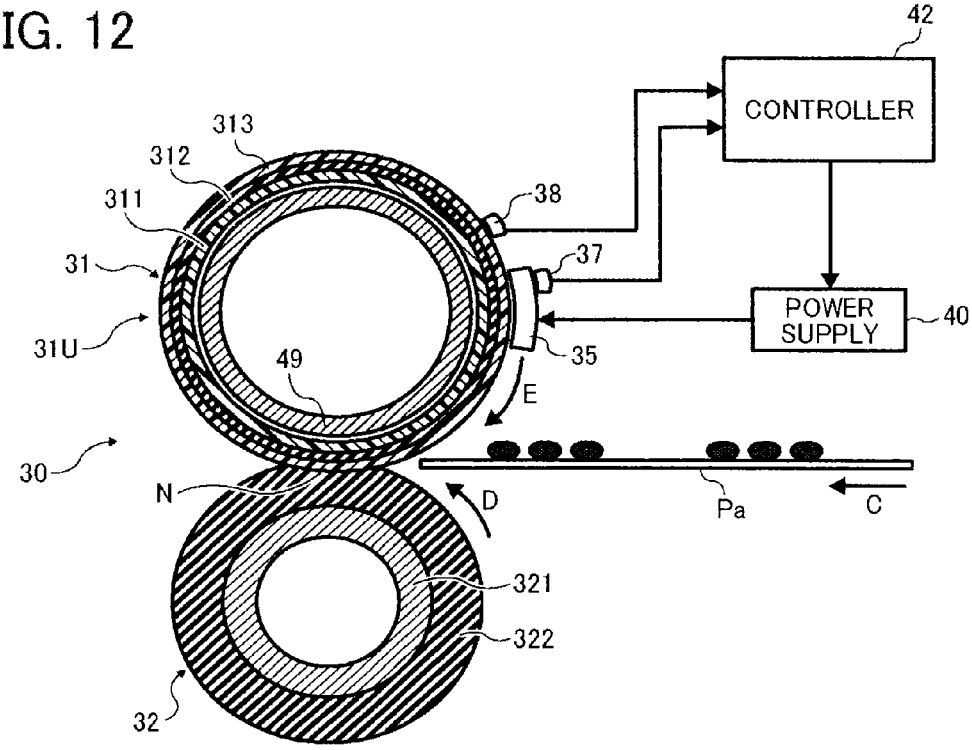
FIG. 12 is a schematic vertical sectional view of a fixing device according to another exemplary embodiment.

With reference to FIG. 12, a description is provided of a construction of a fixing device 30 according to another exemplary embodiment.

FIG. 12 is a schematic vertical sectional view of the fixing device 30. The fixing device 3 depicted in FIG. 2 incorporates the thermal heater 35 situated inside the loop formed by the fixing sleeve 31. Conversely, the fixing device 30 depicted in FIG. 12 incorporates the thermal heater 35 disposed outside the loop formed by the fixing sleeve 31. The skew restraint 39 and the stopper 43 shown in FIGS. 6 to 8 and the skew restraint 71 and the stopper 73 shown in FIGS. 9 to 11 are also applicable to the fixing device 30 shown in FIG. 12. It is to be noted that identical reference numerals are assigned to components shown in FIG. 12 that are identical to the components shown in FIG. 2 and description of the identical components is omitted. Like the fixing sleeve 31 and the pressure roller 32 of the fixing device 3 depicted in FIG. 2, the fixing sleeve 31 and the pressure roller 32 of the fixing device 30 depicted in FIG. 12 form the fixing nip N through which a recording medium Pa bearing a toner image is conveyed.

A support tube 49 having an outer diameter slightly smaller than an inner diameter of the fixing sleeve 31 is disposed opposite the inner circumferential surface of the fixing sleeve 31, thus serving as a support that supports the fixing sleeve 31 and a guide that guides the fixing sleeve 31 by contacting the inner circumferential surface of the fixing sleeve 31 as the fixing sleeve 31 rotates in the rotation direction E. The support tube 49 has a thickness of about 1 mm and is made of metal such as aluminum. Both lateral ends of the support tube 49 in a longitudinal direction thereof parallel to the axial direction of the fixing sleeve 31 are mounted on the side plates 44 depicted in FIG. 6 of the fixing device 30, respectively. The support tube 49 also serves as a nip formation pad that presses against the pressure roller 32 via the fixing sleeve 31 to form the fixing nip N between the fixing sleeve 31 and the pressure roller 32 like the nip formation pad 34 depicted in FIG. 2. An outer circumferential surface of the support tube 49 that comes into contact with the inner circumferential surface of the fixing sleeve 31 is treated with the coating 452*a* depicted in FIG. 6 that is made of abrasion resistant fluoroplastic having a decreased friction coefficient such as PFA and PTFE.

The thermal heater 35 serving as a heater that heats the fixing sleeve 31 contacts the outer circumferential surface of the fixing sleeve 31. The thermistor 37 serving as a temperature detector that detects the temperature of the thermal heater 35 is attached to an outer surface of the thermal heater 35. The thermal heater 35 and the power supply 40 constitute an exterior heater that heats the fixing sleeve 31. The fixing device 30 does not incorporate the pressurization roller 36 shown in FIG. 2. Upstream from the thermal heater 35 in the rotation direction E of the fixing sleeve 31 is the thermistor 38 disposed in proximity to the outer circumferential surface of the fixing sleeve 31 and serving as a temperature detector that detects the temperature of the outer circumferential surface of the fixing sleeve 31. Like the controller 42 of the fixing device 3 depicted in FIG. 2, the controller 42 of the fixing device 30 is operatively connected to the thermistors 37 and 38 and the power supply 40 to control the power supply 40 based on the temperatures of the thermal heater 35 and the fixing sleeve 31 detected by the thermistors 37 and 38, respectively.

The fixing device 30 having the construction described above incorporates one of the skew restraints 39 and 71 depicted in FIGS. 6 and 10, respectively, that is mounted on each of the lateral ends 31*a* and 31*b* of the fixing sleeve 31 and the stopper 43 or 73 that is supported by the side plate 44 in proximity to each of the lateral ends 31*a* and 31*b* of the fixing sleeve 31. Accordingly, as described above, the skew restraints 39 and 71 and the stoppers 43 and 73 restrict movement or skew of the fixing sleeve 31 in the axial direction thereof toward one or another one of the side plates 44, thus preventing buckling and breakage of the lateral ends 31*a* and 31*b* of the fixing sleeve 31.

According to the exemplary embodiments described above, the thermal heater 35 contacts the inner circumferential surface of the fixing sleeve 31 as shown in FIG. 2 or the outer circumferential surface of the fixing sleeve 31 as shown in FIG. 12 to heat the fixing sleeve 31. Alternatively, the fixing devices 3 and 30 may employ an induction heating (IH) method. For example, an IH coil and an inverter constituting a heater that heats the fixing sleeve 31 may be disposed opposite the fixing sleeve 31 without contacting the fixing sleeve 31. In the IH method, the fixing devices 3 and 30 may incorporate a plurality of IH coils or a plurality of offset members that offsets a magnetic flux generated by the IH coil to change a heating span on the fixing sleeve 31 or an amount of heat conducted to the fixing sleeve 31.

Figure 13:
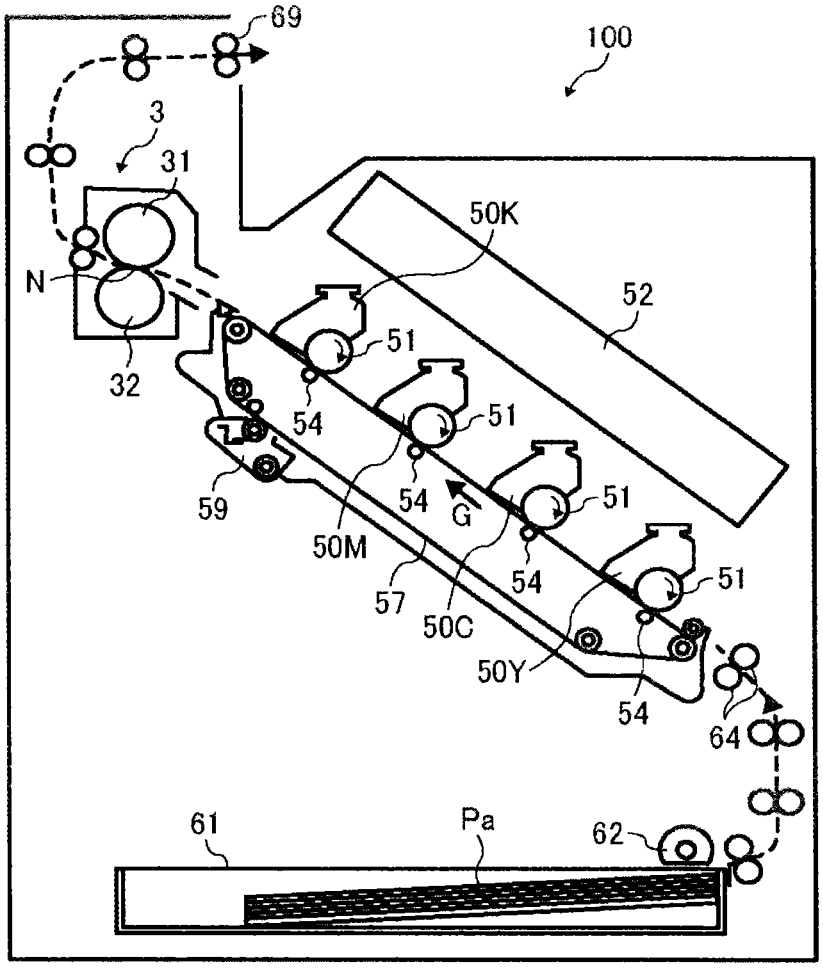
FIG. 13 is a schematic vertical sectional view of an image forming apparatus according to yet another exemplary embodiment.

With reference to FIG. 13, a description is provided of a construction of an image forming apparatus 100 according to yet another exemplary embodiment.

The image forming apparatus 100 includes the fixing device 3. FIG. 13 is a schematic vertical sectional view of the image forming apparatus 100 that forms color and monochrome toner images on recording media (e.g., sheets) by electrophotography. The image forming apparatus 1 shown in FIG. 1 is a monochrome printer that forms a monochrome toner image on a sheet Pa. Conversely, the image forming apparatus 100 shown in FIG. 13 is a color printer that forms a monochrome toner image and a color toner image on a sheet Pa by transferring yellow, magenta, cyan, and black toner images onto the sheet Pa directly.

As shown in FIG. 13, the image forming apparatus 100 includes four process cartridges 50Y, 50C, 50M, and 50K, serving as an image forming device for forming a toner image, aligned along a transfer belt 57 with an identical interval between two adjacent process cartridges of the four process cartridges 50Y, 50C, 50M, and 50K. Each of the four process cartridges 50Y, 50C, 50M, and 50K includes a photoconductive drum 51 serving as an image carrier that carries an electrostatic latent image and a resultant toner image, a charger, a development device, and a cleaner. For example, the development devices visualize electrostatic latent images formed on the photoconductive drums 51 charged by the chargers into yellow, cyan magenta, and black toner images, respectively. As a sheet Pa is conveyed by the transfer belt 57 rotating in a rotation direction G, four transfer bias rollers 54 disposed opposite the four photoconductive drums 51 via the transfer belt 57 transfer the yellow, cyan, magenta, and black toner images formed on the photoconductive drums 51 onto the sheet Pa such that the yellow, cyan, magenta, and black toner images are superimposed on a same position on the sheet Pa.

The transfer belt 57 is an endless belt made of resin such as polyimide (PI), polyvinylidene difluoride (PVDF), ethylene tetrafluoroethylene (ETFE), and polycarbonate (PC). The transfer belt 57 is stretched taut across and supported by a plurality of rollers and rotatable counterclockwise in FIG. 13 in the rotation direction G to convey the sheet Pa.

A description is provided of image forming processes of the image forming apparatus 100 to form a color toner image on a sheet Pa.

The four photoconductive drums 51 of the four process cartridges 50Y, 50C, 50M, and 50K, respectively, rotate clockwise in FIG. 13. In each of the process cartridges 50Y, 50C, 50M, and 50K, the charger charges an outer circumferential surface of the photoconductive drum 51 at a charging position thereon disposed opposite the charger. An exposure device 52 (e.g., an optical writer) emits a laser beam onto the charged outer circumferential surface of the photoconductive drum 51 according to image data of a corresponding color, that is, yellow, cyan, magenta, and black. Thus, the exposure device 52 exposes the charged outer circumferential surface of the photoconductive drum 51, forming an electrostatic latent image of the corresponding color on the photoconductive drum 51.

As the electrostatic latent image formed on the photoconductive drum 51 reaches a development position disposed opposite the development device, the development device supplies toner in the corresponding color to the electrostatic latent image, visualizing the electrostatic latent image into a toner image in the corresponding color. Thereafter, the toner image formed on the photoconductive drum 51 reaches a transfer position disposed opposite the transfer belt 57.

A feed roller 62 picks up and feeds an uppermost sheet Pa of a plurality of sheets Pa loaded on a paper tray 61 to a registration roller pair 64 through a conveyance path. The registration roller pair 64 is situated upstream from the process cartridge 50Y that forms the yellow toner image in a sheet conveyance direction. The registration roller pair 64 conveys the sheet Pa to the transfer belt 57 at a predetermined time. The sheet Pa is attracted to the transfer belt 57 and conveyed by the transfer belt 57 rotating in the rotation direction G. As the sheet Pa moves under the four photoconductive drums 51, the yellow, cyan, magenta, and black toner images formed on the photoconductive drums 51 are transferred onto the sheet Pa successively in this order such that the yellow, cyan, magenta, and black toner images are superimposed on the same position on the sheet Pa. Thus, a color toner image is formed on the sheet Pa.

For example, the transfer bias rollers 54 disposed opposite the photoconductive drums 51 via the transfer belt 57 transfer the yellow, cyan, magenta, and black toner images from the photoconductive drums 51 onto the sheet Pa, respectively. As each of the transfer bias rollers 54 is applied with a transfer voltage having a polarity opposite a polarity of toner of the toner image on the photoconductive drum 51, the transfer bias roller 54 transfers the toner image onto the sheet Pa.

Thereafter, the sheet Pa bearing the color toner image is separated from the transfer belt 57 and conveyed to the fixing device 3. In the fixing device 3, as the sheet Pa is conveyed through the fixing nip N formed between the fixing sleeve 31 and the pressure roller 32, the fixing sleeve 31 and the pressure roller 32 apply heat and pressure to the sheet Pa, fixing the color toner image on the sheet Pa. After being discharged from the fixing device 3, the sheet Pa is discharged onto an outside of the image forming apparatus 100 by an output roller pair 69. On the other hand, after the sheet Pa separates from the transfer belt 57, a belt cleaner 59 cleans an outer circumferential surface of the transfer belt 57 moving under the belt cleaner 59. Thus, a series of image forming processes performed by the image forming apparatus 100 is completed. It is to be noted that the image forming apparatus 100 may incorporate the fixing device 30 depicted in FIG. 12 instead of the fixing device 3.

The fixing devices 3 and 30 incorporate the skew restraint 39 or 71 mounted on each of the lateral ends 31*a* and 31*b* of the fixing sleeve 31 and the stopper 43 or 73 mounted on each of the side plates 44, preventing skew or movement of the fixing sleeve 31 in the axial direction thereof. Even if the fixing devices 3 and 30 are installed in the high speed image forming apparatuses 1 and 100, the fixing devices 3 and 30 prevent skew and resultant breakage of the fixing sleeve 31 and therefore perform precise fixing operation constantly, saving energy.

The image forming apparatus 100 shown in FIG. 13 is a color printer employing a tandem direct transfer method using the plurality of photoconductive drums 51 from which toner images are transferred onto a sheet Pa directly. Alternatively, the image forming apparatus 100 may be a color printer employing a tandem indirect transfer method using the plurality of photoconductive drums 51 from which toner images are transferred onto an intermediate transferor such as an intermediate transfer belt successively such that the toner images are superimposed on a same position on the intermediate transferor and further transferred from the intermediate transferor onto a sheet Pa collectively. Yet alternatively, instead of a tandem structure in which the stationary development devices are disposed opposite the rotatable photoconductive drums 51, respectively, the image forming apparatus 100 may employ a revolver structure in which a plurality of revolving development devices containing yellow, cyan, magenta, and black toners, respectively, comes into contact with a single photoconductive drum successively. The image forming apparatuses 1 and 100 incorporate drum-shaped photoconductors, that is, the photoconductive drums 8 and 51. Alternatively, the image forming apparatuses 1 and 100 may incorporate belt-shaped photoconductors.

According to the exemplary embodiments described above, the controller 42 is incorporated in the fixing devices 3 and 30. Alternatively, the controller 42 may be incorporated in the image forming apparatuses 1 and 100.

A description is provided of advantages of the fixing devices 3 and 30 described above.

As shown in FIGS. 2 and 12, the fixing devices 3 and 30 include a tubular fixing rotator (e.g., the fixing sleeve 31) rotatable in a predetermined direction of rotation to come into contact with a toner image on a recording medium (e.g., a sheet Pa); a roller-shaped pressure rotator (e.g., the pressure roller 32) pressed against the fixing rotator to form the fixing nip N therebetween; a heater (e.g., the thermal heater 35) disposed opposite the fixing rotator to heat the fixing rotator; and a controller (e.g., the controller 42) to control the heater. As the recording medium bearing the toner image is conveyed through the fixing nip N, the fixing rotator and the pressure rotator fix the toner image on the recording medium. As shown in FIGS. 6 and 10, a skew restraint (e.g., the skew restraints 39 and 71) projects from an outer circumferential surface of the fixing rotator radially at each lateral end (e.g., the lateral ends 31*a* and 31*b*) of the fixing rotator in an axial direction thereof. As shown in FIGS. 6 and 10, a support (e.g., the flanges 45 and the side plates 44) rotatably supports the fixing rotator at least at each lateral end of the fixing rotator. A stopper (e.g., the stoppers 43 and 73) is mounted on the support. As the fixing rotator moves in the axial direction thereof, the skew restraint comes into contact with the stopper. Thus, the stopper prevents farther movement of the fixing rotator.

Accordingly, even when the fixing rotator rotates at high speed, each lateral end of the fixing rotator is immune from skew and resultant buckling and breakage, attaining stable rotation of the fixing rotator. Thus, the fixing devices 3 and 30 are installable in the high speed image forming apparatuses 1 and 100 that convey the recording medium at high speed, saving energy.

According to the exemplary embodiments described above, the fixing sleeve 31 serves as a fixing rotator. Alternatively, a fixing film, a fixing belt, or the like may be used as a fixing rotator. Further, the pressure roller 32 serves as a pressure rotator. Alternatively, a pressure belt or the like may be used as a pressure rotator.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotator rotatable in a predetermined direction of rotation;

a pressure rotator pressed against the fixing rotator to form a fixing nip therebetween through which a recording medium bearing a toner image is conveyed;

a first support to rotatably support the fixing rotator at a first lateral end of the fixing rotator in an axial direction thereof, the first support being nonrotatable and extending at least partially inside the fixing rotator;

a second support to rotatably support the fixing rotator at a second lateral end of the fixing rotator in the axial direction thereof, the second support being nonrotatable and extending at least partially inside the fixing rotator;

a first stopper fixedly mounted on the first support; a second stopper fixedly mounted on the second support;

a first skew restraint projecting from an outer circumferential surface of the fixing rotator radially at the first lateral end of the fixing rotator in the axial direction thereof; and a second skew restraint projecting from the outer circumferential surface of the fixing rotator radially at the second lateral end of the fixing rotator in the axial direction thereof, the second skew restraint to come into contact with the second stopper as the fixing rotator moves in the axial direction thereof toward the first support.

2. The fixing device according to claim 1, wherein the first skew restraint and the second skew restraint are disposed outboard from the first stopper and the second stopper, respectively, in the axial direction of the fixing rotator.

3. The fixing device according to claim 1, wherein the fixing rotator includes a fixing sleeve including:

a base layer made of heat resistant resin;

an elastic layer coating the base layer and made of a heat resistant material; and a release layer coating the elastic layer and made of fluoroplastic.

4. The fixing device according to claim 1, wherein each of the first skew restraint and the second skew restraint is elastic to conform to deformation of the fixing rotator caused by rotation.

5. The fixing device according to claim 1, further comprising a guide to come into contact with and guide an inner circumferential surface of the fixing rotator at the first lateral end and the second lateral end of the fixing rotator in the axial direction thereof.

6. The fixing device according to claim 1, wherein each of the first skew restraint and the second skew restraint is a ring made of a heat resistant elastic material and adhered to the outer circumferential surface of the fixing rotator.

7. The fixing device according to claim 6, wherein the heat resistant elastic material includes silicone rubber.

8. The fixing device according to claim 1, wherein each of the first stopper and the second stopper is made of one of metal and rigid heat resistant resin, wherein each of the first stopper and the second stopper includes an arcuate stopper portion curved along the outer circumferential surface of the fixing rotator and projecting toward the outer circumferential surface of the fixing rotator, and wherein as the first lateral end of the fixing rotator moves toward the first support, the second skew restraint comes into contact with the stopper portion of the second stopper.

9. The fixing device according to claim 8, wherein each of the first skew restraint and the second skew restraint includes an inboard face to come into contact with the stopper portion of each of the first stopper and the second stopper, the inboard face including a conical slope having an outer diameter that increases from an inboard to an outboard of each of the first skew restraint and the second skew restraint in the axial direction of the fixing rotator.

10. The fixing device according to claim 8, wherein each of the first support and the second support includes a side plate of the fixing device.

11. The fixing device according to claim 10, wherein each of the first support and the second support further includes a flange mounted on the side plate and mounting each of the first stopper and the second stopper, the flange including:

a guide to come into contact with an inner circumferential surface of the fixing rotator at each of the first lateral end and the second lateral end of the fixing rotator to support and guide the fixing rotator; and a flange face to come into contact with a lateral edge face of the fixing rotator and an outboard face of each of the first skew restraint and the second skew restraint in the axial direction of the fixing rotator.

12. The fixing device according to claim 11, wherein the flange further includes a flange portion mounting the flange face and fastened to the side plate, and wherein each of the first stopper and the second stopper is fastened to the flange portion of the flange with a fastener.

13. The fixing device according to claim 11, wherein each of the first skew restraint and the second skew restraint is interposed between the stopper portion of each of the first stopper and the second stopper and the flange face of the flange.

14. The fixing device according to claim 13, wherein each of the first skew restraint and the second skew restraint is a resin coated ring including:

an interior portion mounted on an inner circumferential surface of the fixing rotator;

an exterior portion disposed opposite the outer circumferential surface of the fixing rotator;

a folding bridging the interior portion and the exterior portion and disposed opposite the lateral edge face of the fixing rotator in the axial direction thereof; and a brim projecting radially from a free end of the exterior portion.

15. The fixing device according to claim 14, wherein each of the first skew restraint and the second skew restraint is made of one of fluoroplastic and heat resistant resin containing fluoroplastic.

16. The fixing device according to claim 14, wherein each of the first stopper and the second stopper includes an arcuate stopper portion curved along the outer circumferential surface of the fixing rotator and projecting toward the outer circumferential surface of the fixing rotator, and wherein as the first lateral end of the fixing rotator moves toward the first support, the brim of the second skew restraint comes into contact with the stopper portion of the second stopper.

17. The fixing device according to claim 16, wherein each of the first stopper and the second stopper is made of one of metal and rigid heat resistant resin and mounted on the side plate, and wherein each of the first stopper and the second stopper further includes a receiver face to come into contact with the folding of each of the first skew restraint and the second skew restraint.

18. A belt device comprising:

an endless belt rotatable in a predetermined direction of rotation;

a first support to rotatably support the endless belt at a first lateral end of the endless belt in an axial direction thereof, the first support being nonrotatable and extending at least partially inside the endless belt;

a second support to rotatably support the endless belt at a second lateral end of the endless belt in the axial direction thereof, the second support being nonrotatable and extending at least partially inside the endless belt;

a first stopper fixedly mounted on the first support; a second stopper fixedly mounted on the second support;

a first skew restraint projecting from an outer circumferential surface of the endless belt radially at the first lateral end of the endless belt in the axial direction thereof; and a second skew restraint projecting from the outer circumferential surface of the endless belt radially at the second lateral end of the endless belt in the axial direction thereof, the second skew restraint to come into contact with the second stopper as the endless belt moves in the axial direction thereof toward the first support.

19. An image forming apparatus comprising:

an image forming device to form a toner image; and a fixing device, disposed downstream from the image forming device in a recording medium conveyance direction, to fix the toner image on a recording medium, the fixing device including:

a fixing rotator rotatable in a predetermined direction of rotation;

a pressure rotator pressed against the fixing rotator to form a fixing nip therebetween through which the recording medium bearing the toner image is conveyed;

a first support to rotatably support the fixing rotator at a first lateral end of the fixing rotator in an axial direction thereof, the first support being nonrotatable and extending at least partially inside the fixing rotator;

a second support to rotatably support the fixing rotator at a second lateral end of the fixing rotator in the axial direction thereof, the second support being nonrotatable and extending at least partially inside the fixing rotator;

a first stopper fixedly mounted on the first support; a second stopper fixedly mounted on the second support;

a first skew restraint projecting from an outer circumferential surface of the fixing rotator radially at the first lateral end of the fixing rotator in the axial direction thereof; and a second skew restraint projecting from the outer circumferential surface of the fixing rotator radially at the second lateral end of the fixing rotator in the axial direction thereof, the second skew restraint to come into contact with the second stopper as the fixing rotator moves in the axial direction thereof toward the first support.

20. The image forming apparatus according to claim 19, further comprising a controller operatively connected to the fixing device, wherein the fixing device further includes a heater connected to the controller and disposed opposite the fixing rotator to heat the fixing rotator, the heater including a plurality of heating portions aligned in the axial direction of the fixing rotator perpendicular to a recording medium conveyance direction, and wherein the controller selectively controls at least one of the plurality of heating portions according to an image area on the recording medium to heat an image region on the fixing rotator disposed opposite the image area on the recording medium to a first target temperature and to heat a blank region on the fixing rotator disposed opposite a blank area on the recording medium to a second target temperature lower than the first target temperature.

* * * * *